US005653860A

United States Patent [19]

Nicholls et al.

[11] Patent Number: 5,653,860

[45] Date of Patent: Aug. 5, 1997

[54] SYSTEM FOR ULTRASONIC REMOVAL OF AIR BUBBLES FROM THE SURFACE OF AN ELECTROPLATED ARTICLE

[75] Inventors: Louis W. Nicholls, Durham; Waite R. Warren, Jr., Raleigh, both of N.C.

[73] Assignee: Mitsubishi Semiconductor America, Inc., Durham, N.C.

[21] Appl. No.: 641,792

[22] Filed: May 2, 1996

[51] Int. Cl.[6] ..... C25D 5/20; C25D 17/28

[52] U.S. Cl. ..... 205/80; 204/198; 204/222; 134/1

[58] Field of Search ..... 204/222, 198; 134/1; 205/80

[56] References Cited

U.S. PATENT DOCUMENTS

| | | | |
|---|---|---|---|
| 2,744,860 | 5/1956 | Rines | 204/222 X |
| 3,753,889 | 8/1973 | Eisner . | |
| 4,178,188 | 12/1979 | Dussault et al. | 134/1 |
| 4,229,276 | 10/1980 | Kobayashi et al. . | |
| 4,425,204 | 1/1984 | McLaughlin | 204/222 X |
| 4,441,976 | 4/1984 | Iemmi et al. . | |
| 4,685,415 | 8/1987 | Wegner . | |
| 4,698,207 | 10/1987 | Bringham et al. . | |
| 4,752,367 | 6/1988 | Vishnitsky . | |
| 4,876,066 | 10/1989 | Bringham et al. . | |
| 4,889,603 | 12/1989 | DiSanto et al. . | |
| 5,166,037 | 11/1992 | Atkinson et al. . | |
| 5,167,779 | 12/1992 | Henig . | |
| 5,217,598 | 6/1993 | Sawa et al. . | |
| 5,316,642 | 5/1994 | Young, Jr. et al. . | |
| 5,391,290 | 2/1995 | Ichiba et la. . | |
| 5,407,544 | 4/1995 | Oehr et al. . | |
| 5,409,594 | 4/1995 | Al-Jiboory et al. | 204/222 X |
| 5,427,622 | 6/1995 | Stanasolovich et al. | 134/1 |

*Primary Examiner*—Donald R. Valentine
*Attorney, Agent, or Firm*—Lowe, Price, LeBlanc & Becker

[57] ABSTRACT

During electroplating, an article immersed in an electroplating solution is held by an ultrasonic transducer supplied with an alternating-current energy produced by an ultrasonic generator. The ultrasonic transducer converts the alternating-current energy to mechanical vibrations at an ultrasonic frequency corresponding to the excitation frequency. The mechanical vibrations produced by the transducer are applied directly to the article to cause it to vibrate at the ultrasonic frequency. This vibration results in removing air bubbles from the article surface.

11 Claims, 3 Drawing Sheets

SYSTEM FOR ULTRASONIC REMOVAL OF AIR BUBBLES FROM THE SURFACE OF AN ELECTROPLATED ARTICLE

TECHNICAL FIELD

The present invention relates to electroplating, and more particularly, to eliminating air bubbles adhered to the surface of an article immersed in an electrolyte solution.

BACKGROUND ART

To deposit a metal or alloy from a suitable electrolyte solution, the article to be plated is connected as a cathode in the electrolyte solution. Direct current is introduced through an anode which consists of the metal or alloy to be deposited. In accordance with the first law of electrolysis, the weight of the deposit on the cathode is proportional to the product of the current density multiplied by the time of deposition. Accordingly, the rate of deposition is proportional to the current density. For example, silver will deposit at 10 Å/s at a current density of 1 $mA/cm^2$, and this will rise to a 1 μ/s at 1 $A/cm^2$.

However, during electrodeposition, a diffusion layer of metal ions is created in the electrolyte solution adjacent the surface of the electroplated article. This diffusion layer results in decreasing the current density. To prevent the diffusion layer of metal ions from being formed, ultrasonic vibration is applied to the electrolyte solution between the article and the anode.

For example, U.S. Pat. No. 5,391,290 discloses a method of electroplating a metal strip moved through an electroplating tank with an acidic tin-electroplating solution. A plurality of ultrasonic vibrators are placed along the surface of an anode located near the bottom of the tank. The vibrators are connected to an external ultrasonic generator to cause the vibration of the anode, and hence the vibration of the acidic tin-electroplating solution between the anode and the metal strip. Thus, a diffusion layer of tin ions formed in the acidic tin-electroplating solution adjacent the surface of the metal strip is removed.

Another problem that needs to be solved during electroplating is caused by air bubbles adhered to the surface of an electroplated article when the article pretreated in various chemical solutions is immersed in an electroplating solution. The surface portions covered with the air bubbles cannot be processed by the electroplating solution, and hence, no material can be deposited on these portions. In the conventional electroplating system discussed above, the air bubbles cannot be removed from the surface of an electroplated article, because vibration applied to the electroplating solution would cause the air bubbles to be trapped beneath the article. Accordingly, the air bubbles adhered to the bottom surface of the article would not be eliminated. This problem becomes increasingly apparent when articles have complicated shapes, or viscous electroplating solutions are used.

Moreover, as discussed above, electroplating tanks in conventional electroplating systems are provided with complicated ultrasonic equipment that increases the cost of electroplating.

Therefore, it would be desirable to provide an ultrasonic system for removing air bubbles adhered to an article immersed in an electroplating solution.

Also, it would be desirable to provide an air bubble removal system that is low in cost and easily implemented.

DISCLOSURE OF THE INVENTION

Accordingly, one advantage of the present invention is in providing an ultrasonic system for removing air bubbles adhered to the surface of an article immersed in an electroplating solution.

Another advantage of the present invention is in providing an air bubble removal system that is low in cost and easily implemented.

The above and other advantages of the invention are achieved, at least in part, by providing a system for air bubble removal that comprises a generator for producing alternating-current energy, and a transducer coupled to the generator for converting the alternating-current energy to mechanical vibrations. The article immersed in a liquid is mechanically joined with the transducer so as to establish a solid medium for propagation of the mechanical vibrations from the transducer to the article, to remove the air bubbles from the surface of the article.

In accordance with one aspect of the invention, the alternating-current energy is generated at an ultrasonic frequency to cause the mechanical vibrations of the same frequency.

In accordance with another aspect of the invention, the article to be electroplated may be attached to a rigid conveyor belt passing through a plating bath with an electrolyte solution. The transducer may have a clamp portion with a slot for receiving the rigid conveyor belt. Before electroplating, the conveyor belt transports the article through pretreating stations. For example, the article may comprise an integrated circuit (IC) lead frame that contains IC packages with leads to be electroplated.

In accordance with the method of the present invention, the following steps are carried out: generating alternating-current energy at an ultrasonic frequency, converting the alternating-current energy to mechanical vibrations of the ultrasonic frequency, and applying the mechanical vibrations to the article immersed in an electrolyte solution through a solid medium to cause the article to vibrate.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

BEST MODE FOR CARRYING OUT THE INVENTION

Although the invention has general applicability in the field of electroplating, the best mode for practicing the invention is based in part on the realization of a system that applies ultrasonic vibrations to remove air bubbles from the surface of an electroplated article. However, it should be understood that the invention is applicable in the general case to eliminating any gas bubbles adhered to the surface of an article immersed in a liquid by applying to the article any type of mechanical vibrations.

Figure 1:
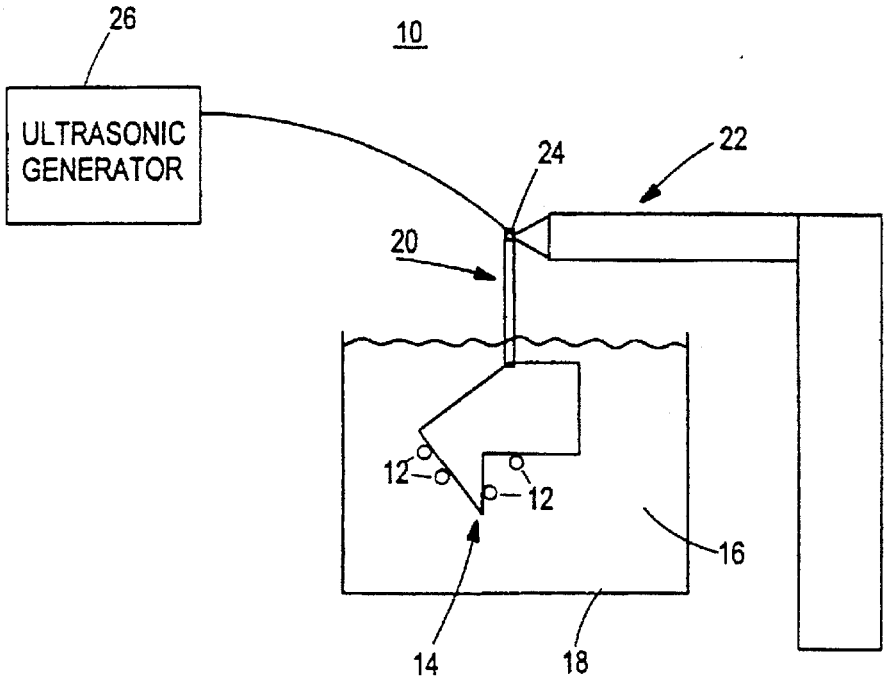
FIG. 1 schematically illustrates an air bubble removal system of the present invention.

Reference is now made to FIG. 1 that schematically illustrates an ultrasonic system 10 for removing air bubbles 12 adhered to surfaces of an article 14 immersed in a chemical solution 16 used for electroplating the article 14 in a plating bath 18. For example, the article 14 may have a complicated polygonal shape. The air bubbles 12 trapped on the bottom surfaces of the article 14 cannot be removed using conventional procedures.

During electroplating, the article 14 is held by a holding element 20 fixed to a support fixture 20. A movable joint 24 is used to connect the holding element 20 to the support fixture in order to enable the held article 14 to vibrate.

An ultrasonic generator 26 is coupled to the holding element 20 to supply it with an alternating-current energy at an excitation frequency in an ultrasonic range, for example, from 16 kHz to 40 kHz. The holding element 20 is a piezoelectric ultrasonic transducer that converts the ultrasonic electrical energy into ultrasonic mechanical vibrations at a frequency corresponding to the excitation frequency.

Figure 2:
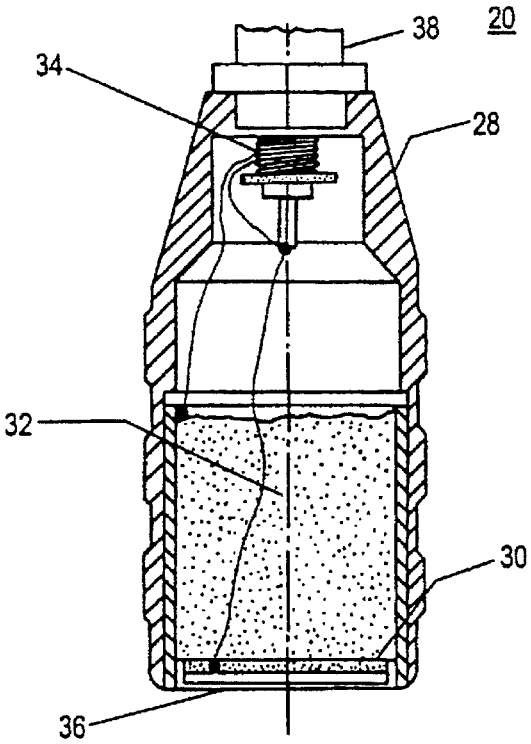
FIG. 2 shows an example of a piezoelectric transducer.

Reference is now made to FIG. 2 that shows an example of the ultrasonic transducer 20 having a housing 28 that incorporates a piezoelectric crystal 30 made of piezoelectric material such as quartz, barium titanate and lead zirconate. The piezoelectric material is coated with an electrical conductor on two parallel surfaces. When a voltage is applied to the conductor, the piezoelectric crystal changes its thickness by an amount dependent on the voltage. The transducer 20 may be mechanically damped by a high-density, highly absorbent backing layer 32 to ensure a reasonable bandwidth and to reduce ringing and spurious echoes from inside the transducer.

The ultrasonic generator 26 is coupled to the transducer 20 through a conducting cable, as shown on FIG. 1. To match electrical impedance between the ultrasonic generator and the transducer at the desired nominal frequency to obtain maximum power transfer and to avoid electrical reflections in the cable, a tuning coil 34 may be connected to the crystal 30. The movable joint 24 that connects the transducer 20 to the supporting element 22 may be coupled to a coupling tube 38. The article 14 may be attached to a bottom surface 36 to provide a rigid mechanical link between the transducer 20 and the article 14.

Figure 3:
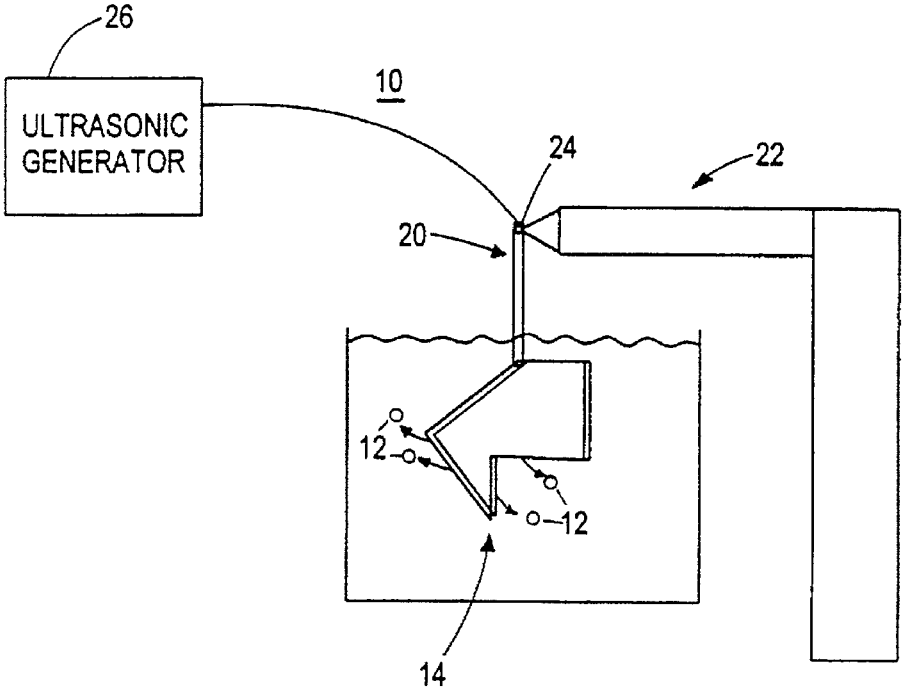
FIG. 3 illustrates applying mechanical vibrations to an article immersed in an electroplating solution.
Figure 7:
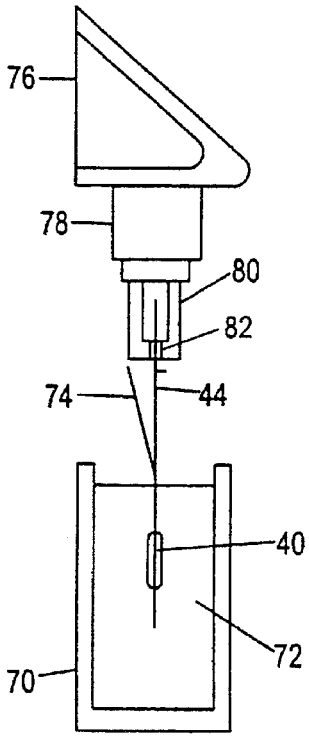
FIGS. 6 and 7 respectively show perspective and side views of a plating station of the present invention.

As shown in FIG. 3, mechanical vibrations produced by the transducer 20 are applied directly to the article 14 to cause it to vibrate at an ultrasonic frequency. This vibration causes air bubbles 12 to be removed from the article surface, even if they were trapped on the bottom surface.

Reference is now made to FIGS. 4–7 that illustrate an application of the present invention to electroplating of an integrated circuit (IC) lead frame based, for example, on a strip of nickel alloy metal. IC chips are attached to the metal strip, and their leads are wired to the strip. Each IC chip is encapsulated into a plastic package to form an IC package.

Figure 4:
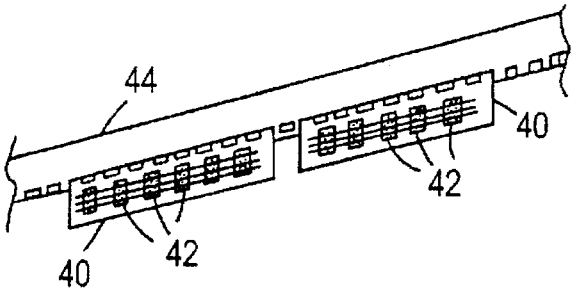
FIG. 4 shows a conveyor belt that transports an IC lead frame to be electroplated.
Figure 5:
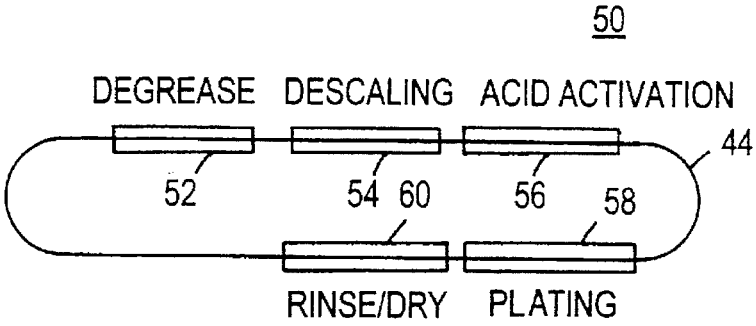
FIG. 5 illustrates a plating machine of the present invention.
Figure 6:
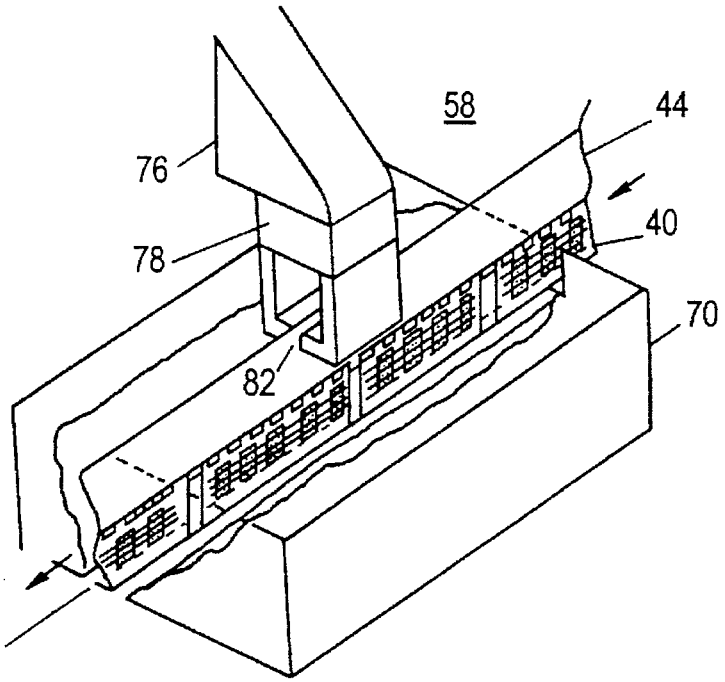

As shown in FIG. 4, an IC lead frame 40 containing IC packages 42 is fixed to a stainless steel conveyor belt 44 that carries the frame 40 through various stations of a plating machine 50. Referring to FIG. 5, the plating machine 50 incorporates a degrease station 52 that cleans grease and foreign matter from the surface of the IC lead frame 40. Then, a descaling station 54 removes oxides from the metal surface of the frame An activation station 56 treats the frame 40 in an acid bath to deoxidize pores of the metal. A plating station 58 electroplates the IC lead frame 40 to deposit a desired material on the IC leads. A rinse/dry station 60 fully rinses the frame 40 and dries it. Finally, the IC lead frame 40 is released from the conveyor belt Reference is now made to FIGS. 6 and 7 respectively showing perspective and side views of the plating station 58 that contains a plating bath 70 with an electrolyte solution 72. The IC lead frames 40 are mounted on the stainless steel conveyor belt 44 that transports them through the electrolyte solution 72 to electroplate IC leads. A clip 74 is used to fasten the IC lead frame 40 to the conveyor belt 44. An ultrasonic transducer mount 76 positions an ultrasonic transducer 78 above the conveyor belt 44. The ultrasonic transducer 78 is supplied with alternating-current energy at an ultrasonic frequency to produce mechanical vibrations of the same frequency. The ultrasonic transducer 78 has a clamp portion 80 with a slot 82 for receiving the conveyor belt 44 that passes through the plating bath 72. The clamp portion 80 firmly accommodates the passing conveyor belt 44 so as to provide effective transfer of mechanical vibrations produced by the ultrasonic transducer 76 to the stainless steel belt 44 that carries the IC lead frame 40. The ultrasonic mechanical vibrations propagating through the stainless steel belt 44 are applied to the IC lead frame 40 to eliminate air bubbles trapped on the lead frame surface.

There accordingly has been described a system for removing air bubbles adhered to the surface of an electroplated article. During electroplating, the article is held by an ultrasonic transducer supplied with an ultrasonic electrical excitation signal produced by an ultrasonic generator. The ultrasonic transducer converts the ultrasonic electrical signal into ultrasonic mechanical vibrations at a frequency corresponding to the excitation frequency of the generator. The mechanical vibrations produced by the transducer are applied directly to the article to cause it to vibrate at an ultrasonic frequency. This vibration results in removing air bubbles from the article surface.

In this disclosure, there are shown and described only the preferred embodiments of the invention, but it is to be understood that the invention is capable of changes and modifications within the scope of the inventive concept as expressed herein.

We claim:

1. A system for removing gas bubbles adhered to an article immersed in electroplating solution comprising:

a generator for producing alternating-current energy, a transducer coupled to said generator for converting the alternating-current energy to mechanical vibrations, and a rigid conveyor belt for transporting the article through the electroplating solution, said belt being adapted for mechanically joining said article with said transducer so as to establish a solid medium for propagation of the mechanical vibrations from said transducer to said article, so as to remove the gas bubbles from a surface of the article.

2. The system of claim 1, wherein said generator produces alternating-current energy at an ultrasonic frequency to develop mechanical vibrations at the ultrasonic frequency.

3. The system of claim 1, wherein said transducer has a clamp portion with a slot for receiving said rigid conveyor belt.

4. The system of claim 3, wherein said conveyor belt is made of metal.

5. The system of claim 3, wherein said conveyor belt is adapted to transport said article through stations for pretreating said article before electroplating.

6. The system of claim 3, wherein said belt is adapted to transport an article that comprises an integrated circuit (IC) lead frame containing IC packages with leads to be electroplated.

7. A method for removing air bubbles from an article immersed in an electroplating solution comprising the steps of:

transporting said article through the electroplating solution using a rigid conveyor belt, producing alternating-current energy at a ultrasonic frequency, converting the alternating-current energy to mechanical vibrations at the ultrasonic frequency, and applying the mechanical vibrations to said article through said rigid conveyor belt to cause said article to vibrate, in order to remove the air bubbles from said article.

8. A system for electroplating an article comprising:

a plating bath adapted to hold an electrolyte solution, a rigid conveyor belt for transporting said article through said plating bath, an ultrasonic generator for producing alternating-current energy, and an ultrasonic transducer coupled to said ultrasonic generator for converting the alternating-current energy to mechanical vibrations, said ultrasonic transducer being adapted for being mechanically linked with said rigid conveyor belt so as to cause said article to vibrate, in order to remove air bubbles trapped on a surface of the article during electroplating.

9. The system of claim 8, wherein said ultrasonic transducer has a clamp portion with a slot for receiving said rigid conveyor belt.

10. The system of claim 8, wherein said belt is adapted to transport an article that comprises an IC lead frame having IC leads to be electroplated.

11. The system of claim 8, wherein said rigid conveyor belt is adapted to transport said article through pretreatment stations before electroplating.

* * * * *